United States Patent [19]

Jannotta

[11] Patent Number: 4,838,249

[45] Date of Patent: Jun. 13, 1989

[54] LOWER BACK THERAPY DEVICE

[76] Inventor: Anthony S. Jannotta, 2814 Kingswell Dr., Wheaton, Md. 20902

[21] Appl. No.: 155,525

[22] Filed: Feb. 12, 1988

Related U.S. Application Data

[63] Continuation-in-part of Ser. No. 865,363, May 21, 1986, abandoned.

[51] Int. Cl.[4] ..... A61H 1/02

[52] U.S. Cl. ..... 128/25 R; 128/75

[58] Field of Search ..... 128/25 R, 68–75, 128/84 R, 84 C, 133, 134; 272/93, 144, 145; 296/328; 5/417, 420, 431

[56] References Cited

U.S. PATENT DOCUMENTS

| | | | |
|---|---|---|---|
| D. 246,816 | 1/1978 | Tam et al. | D6/09 |
| D. 276,938 | 12/1984 | Pedersen | D24/36 |
| 2,469,084 | 5/1949 | Schenker | 5/91 |
| 2,521,530 | 9/1950 | McGuffage | 5/327 |
| 3,213,853 | 10/1965 | Mulkin | 128/69 |
| 3,573,866 | 4/1971 | Madden | 272/117 |
| 3,672,361 | 6/1972 | Fourneron | 272/144 X |
| 3,747,916 | 7/1973 | Benson | 269/322 |
| 3,986,499 | 10/1976 | Fischer | 128/71 |
| 4,102,336 | 7/1978 | Wiener et al. | 128/75 |
| 4,118,813 | 10/1978 | Armstrong | 5/337 |
| 4,207,635 | 6/1980 | Leroy | 5/437 |
| 4,471,952 | 9/1984 | Spann | 269/328 |
| 4,473,913 | 10/1984 | Ylvisaker | 5/435 |
| 4,489,936 | 12/1984 | Dal Monte | 277/144 |
| 4,508,335 | 4/1985 | Kelley et al. | 272/145 |
| 4,523,583 | 6/1985 | Noble | 128/71 |
| 4,624,245 | 11/1986 | Mullen et al. | 128/75 |

FOREIGN PATENT DOCUMENTS

| | | | |
|---|---|---|---|
| 2717373 | 10/1978 | Fed. Rep. of Germany | 272/144 |

*Primary Examiner*—Richard J. Apley
*Assistant Examiner*—J. Welsh
*Attorney, Agent, or Firm*—Armstrong, Nikaido Marmelstein & Kubovcik

[57] ABSTRACT

An apparatus for relieving back stress composed of a body support cushion which is attached on its bottom surface to a rigid base member. The body support cushion supports the torso of a user. Attached to the rigid base member is an elevated restraint cushion which is positioned over the rear of, or behind the body cushion. The body support cushion, along with a force exerted by the restraint cushion on the thighs and pelvis of the user, allows for the immobilization of the lumbar spine in a state of flexion or extension. In addition to relieving back stress, the device can be used to perform various exercises.

21 Claims, 7 Drawing Sheets

LOWER BACK THERAPY DEVICE

CROSS REFERENCE TO RELATED APPLICATION

This application is a continuation-in-part of U.S. Ser. No. 865,363, filed May 21, 1986, now abandoned.

BACKGROUND OF THE INVENTION

1. Field of the Invention

This invention relates to a device, and a method of using the device, to provide exercise, relief and therapeutic treatment to persons suffering from back discomfort.

2. Description of the Prior Art

There are known devices which aid or provide relief to individuals suffering from lower back stress or strain. For instance, U.S. Pat. No. 4,473,913 to Ylviskar relates to an elongate cushion for therapeutically supporting a person in a prone- or supine-type position to relieve back stress. U.S. Pat. No. 4,207,635 to Leroy is directed to a similar device. However, neither device discloses means for maintaining or securing a user in the therapeutic position. Without such support, a user may still experience a degree of back stress, or continue to suffer from the pain that he desires to avoid.

Other devices known in the art range from adjustable traction tables, to traction systems utilizing harness and complex pulley, weight and gravity devices. However, such devices are large and cumbersome in use and do not lend themselves to easy, routine use in the home.

OBJECTS OF THE INVENTION

In view of the above, an object of this invention is to overcome the deficiencies of the prior art.

Another object of the invention is to provide an apparatus that will allow immobilization of the lumbar spine to a state of flexion while supporting a user in a comfortable and relaxed position.

Still another object of this invention is to provide an apparatus that will allow immobilization of the lumbar spine to a state of extension while supporting a user in a comfortable and relaxed position.

Still another object of the invention is to provide an apparatus that will facilitate the performance of dynamic extension exercises.

Still another object of this invention is to allow manual application of spinal traction to the lumbar spine while immobilizing the lumbar spine in a state of flexion.

Still another object of the device is to provide an apparatus that will facilitate the performance of abdominal exercises.

Still another object is to accomplish the foregoing objects with an apparatus that is small, simple and easy and convenient to use.

SUMMARY OF THE INVENTION

The invention relates to an apparatus for relieving stress in the lumbar spine. Such stress is often the cause of lower back discomfort. The apparatus, in a first embodiment, is composed of a body support cushion having a convex profile which is attached on its bottom surface to a rigid base member. Attached to the rigid base member is an elevated restraint cushion which is positioned over the rear of, or behind, the body cushion. A user positions himself on the body cushion, in either a prone position or a supine position, so that the restraint cushion exerts a downward force upon the area associated with thighs and lower pelvis of the user. The convex profile of the body support cushion, along with the downward force of the restraint cushion, allows for the mobilization of the lumbar spine to a state of flexion or extension. In another embodiment, the device is adjustable and, in further embodiments, the device can be used to apply traction to the lumbar spine. In still another embodiment an alternate design for an exercise device is presented.

DESCRIPTION OF THE INVENTION

As a matter of convention, with reference to all figures in this specification, the term "front" will refer to the left-hand side of the figure or object; "forward", to the direction to the left; "rear" to the right-hand side of the figure or object; "backward" to the direction to the right; "upward" to the direction toward the top; "downward" to the direction toward the bottom, and with reference to the body of a user of the device "upper" refers to the direction toward the head and "lower" to the direction toward the feet.

Figure 2:
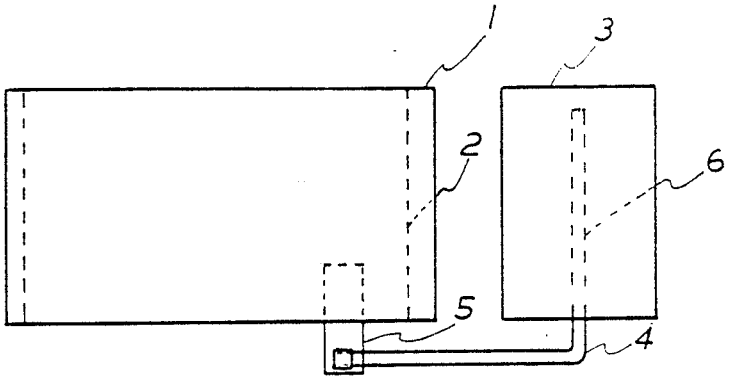
FIG. 2 is a top plan view of the apparatus of FIG. 1.
Figure 1:
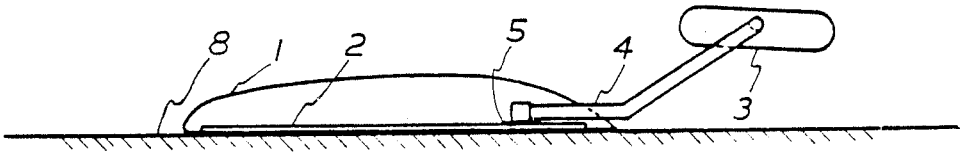
FIG. 1 is a side elevation of the apparatus of the invention for relieving back stress.

Referring to FIGS. 1 and 2, the plan and top views, respectively, of a first preferred embodiment, the means for elevating the upper torso is composed of a body support cushion 1, which is rectangular in shape (FIG. 2), is of a generally convex profile along its top surface, a generally flat profile along its bottom surface (FIG. 1), and is constructed primarily of a resilient cushioning material, such as foam rubber. The body support cushion has a width, the dimensions of which will, at least, support the torso of a large adult male lying in a prone or supine position. The body support cushion 1 is mounted upon the rigid base member 2. Rigid base member 2 is rectangular in shape, is of a thin, flat profile having a top face and a floor-engaging bottom face and is constructed of a stiff, light-weight material, such as a plastic or metal. The body support cushion 1 is attached to the rigid base member 2 by conventional means, such as glue. Alternatively male and female fastening means may be used so that the body support cushion may be easily attached to or removed from the rigid base member.

A downward restraint cushion 3 acts as a means for exerting a downward restraining force upon the area associated with the thighs and lower pelvis of a user of the device. The downward restraint cushion is rectangular in shape (FIG. 2), is of a flattened, elongated oval profile (FIG. 1), and is constructed primarily of a resilient cushioning material, such as foam rubber. The length of the downward restraint cushion is substantially equal to the width of the body support cushion. This is shown in FIG. 1 where "L" represents the length of downward restraint cushion 3 and "W" represents the width of body support cushion 1.

Since the function of the downward restraint cushion 3 is to exert a downward restraining force it must be capable of absorbing the opposite and equal reaction to that force. In all of the embodiments discussed in this specification, the downward restraint cushion 3 is rigidly connected to the rigid base member 2, allowing the reaction to the downward restraining force to be transmitted to the rigid base member 2. As will be seen, the rigid base member 2 is held fixed in place by the body weight of the user (shown in FIG. 3).

The means for rigidly attaching the downward restraint cushion 3 to the rigid base member 2 is composed of a mechanical connecting member 4, a rigid, arm-like structure constructed of a stiff, lightweight material, such as a plastic or metal, and a small rectangular plate 5. The rear end of the mechanical connecting member 4 is placed into the channel 6 located on one side of the downward restraint cushion 3. The channel 6 provides for a rigid connection but also allows for the easy removal and replacement of the downward restraint cushion 3. For instance the channel 6 may be lined with a metal sleeve, capable of slidingly engaging with the rear end of the mechanical connecting member 4. A tongue and groove fastening means may be provided to the sleeve and rear end of the mechanical connecting member 4. Basically, the fastening means is not critical, but where desired such means should allow for the easy removal and replacement of the body support cushion. The front end of the mechanical connecting member 4 is rigidly attached to the rectangular plate 5, which is rigidly attached to the side of the rigid base member 2. The mechanical connecting member 4 is therefore situated entirely to one side of the body support cushion 1. However, it should be understood that the mechanical connecting member 4 could be fastened to the center and rear of the rigid base member 2. In this manner, the legs of a user would straddle the connecting member. The device is positioned on a flat, horizontal support surface 8 which is generally a floor. Such a feature is commonly shown in FIG. 12. The support surface 8 acts to support the weight of the device and user and, as will be seen, it serves the function of maintaining the legs of the user in a generally horizontal position.

Figure 7:
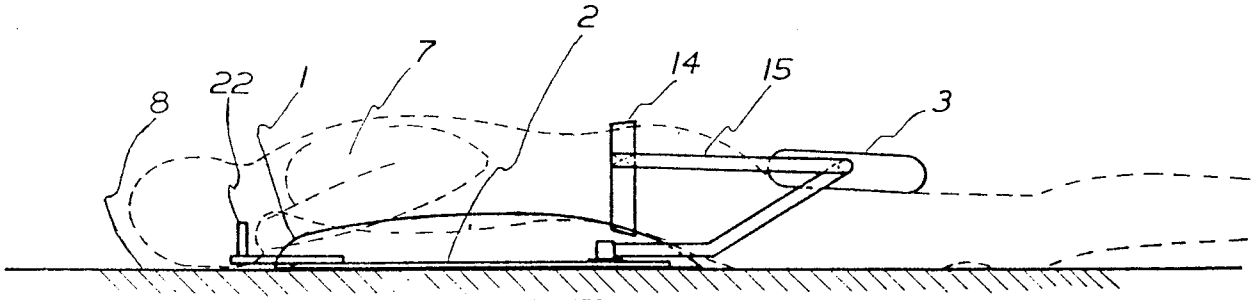
FIG. 7 shows another embodiment of the device which allows the user to place the lumbar spine in traction.

The device may also include gripping means located at the front of rigid base member. The gripping means may include pegs or handles as shown in FIG. 7 which are located at either side of the rigid base member and are substantially perpendicular to the rigid base member 2. The gripping means may also include a horizontal bar fastened to the top of the pegs and which is located in a horizontal plane between the rigid base member 2 and downward restraint cushion 3.

Figure 3:
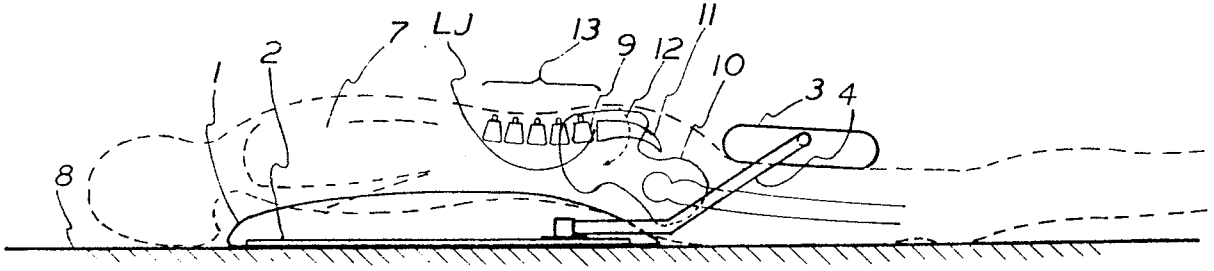
FIG. 3 is the device of FIG. 1, with a user in a prone position and the lumbar spine in a state of flexion.

Referring to FIG. 3, a method for immobilization the lumbar spine 13 in a state of flexion is illustrated (flexion of the lumbar spine corresponds to a decrease in the natural curvature of the lumbar spine, as in the action of a person bending forward to touch the toes). The user 7 is lying on the device in a prone position, the body support cushion 1 is positioned underneath the user 7, contacting primarily the ventral surface of the upper torso, elevating the same relative to the support surface 8. The downward restraint cushion 3 contacts primarily the area of the posterior thighs and lower buttocks and exerts a downward restraining force upon the area associated with the thighs and lower region of the pelvis 10. In order to contact the thighs and the complete buttocks of an individual the downward restraint cushion 3 is constructured to have a length equal to the width of body support cushion 1.

Resulting from the simultaneous elevation of the upper torso and downward restraint to the thighs and lower pelvis is the rotation of the pelvis 10 generally about the lumbo-sacral joint LJ (the space between the bottom most lumbar vertabrae 9 and the sacrum 11; see FIG. 3) in the direction of the arrow 12, producing flexion of the lumbar spine 13. As previously mentioned, the support surface 8 acts to keep the legs of the user 7 in a generally horizontal position, which ensures that the downward force from the downward restraint cushion 3 has the desired effect of forcing the thighs and lower pelvis downward toward the support surface 8. The convex profile of the body support cushion and the downward force of the restraint cushion also support the user in a desired therapeutic position, such as flexion or extension.

Figure 4:
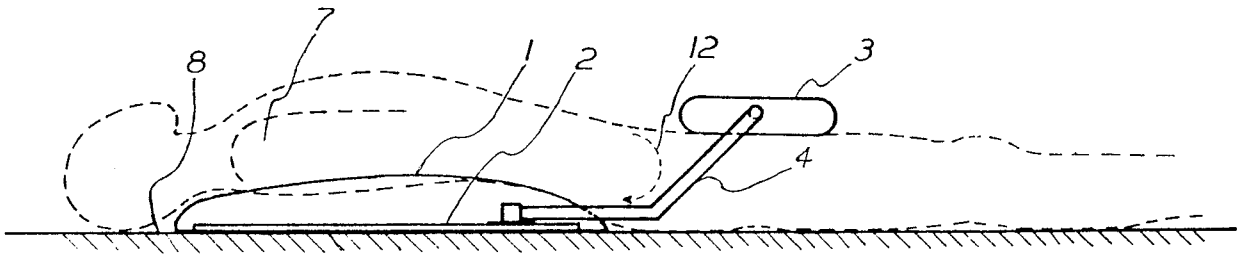
FIG. 4 is the device of FIG. 1, with a user in a supine position and the lumbar spine in a state of extension.

In FIG. 4, the same embodiment is shown in a method for immobilizing the lumbar spine 13 in a state of extension (extension of the lumbar spine corresponds to an increase in the natural lumbar curvature, as in the act of bending over backwards, or in "arching" the back). As in the previous example of FIG. 3, the body support cushion 1 acts to elevate the upper torso relative to the support surface 8, while the downward restraint cushion 3 exerts a downward force upon the area associated with the thighs and lower pelvis. This time, however, the user 7 is lying on the device in a supine position so that the device has exactly the opposite effect. The pelvis is again rotated in the direction of the arrow 12; however, this is the opposite direction relative to the user 7. Therefore, the operation of the device relative to the upper torso, thighs and lower pelvis is the same in the examples of FIGS. 3 and 4. However, in the example of FIG. 3, with the user 7 in a prone position, the result is immobilization of the lumbar spine in a state of flexion, whereas in the example of FIG. 4, with the user 7 in a supine position, the result is immobilization of the lumbar spine in a state of extension.

Figure 5:
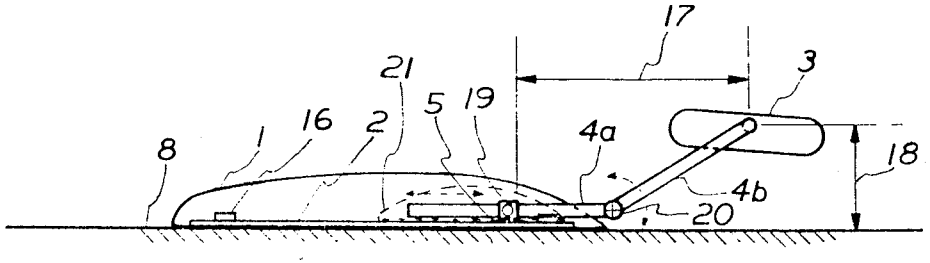
FIG. 5 is a side elevation of the apparatus of this invention having means for primarily adjusting the position of the restraint cushion.

A second preferred embodiment comprises all of the features of the first, with the added element of adjustability, and is illustrated in FIG. 5. The body support cushion 1 is removably attached to the rigid base member 2 with male and female snaps 16 (four male members near each corner of rigid base member 2 and four female members positioned on the base of the body support cushion to mate with the male member). This is to allow the replacement of the body support cushion 1 with a different cushion which might be of different profile and/or firmness. The body support cushion 1 also incorporates an adjustable air bladder 21, which is located at the core of, and toward the rear of, the body support cushion and which enables adjustment of the elevation and firmness of the rear section of the body support cushion 1. Referring back to FIGS. 3 and 4, respectively, inflation of the air bladder 21 would cause an increase in elevation of the upper torso relative to the support surface 8, which would result in an increase in the degree of flexion or extension which is being applied. Deflation of the air bladder 21 would cause a corresponding decrease in the degree of flexion or extension applied. Adjustment of the air bladder 21 could be accomplished with a small hand pump and bleed valve.

The horizontal distance between the downward restraint cushion 3 and the body support cushion 1, or the dimension 17, is made adjustable. This is accomplished by attaching the front section of the mechanical connecting member 4*a* to the rectangular plate 5 with a mechanism 19, which can be loosened to allow the forward and backward movement of the front section of the mechanical connecting member 4*a* (relative to the body support cushion 1), and retightened to maintain the desired setting. The vertical distance between the downward restraint cushion 3 and the support surface 8, or the dimension 18, can be varied by rotation of the rear section of the mechanical connecting member 4*b* about the mechanism 20, which can be loosened to allow adjustment, and retightened to maintain the desired setting. This embodiment, with adjustability of the body support cushion and of dimensions 17 and 18, enables the device to accommodate persons of practically any size and build.

Figure 6:
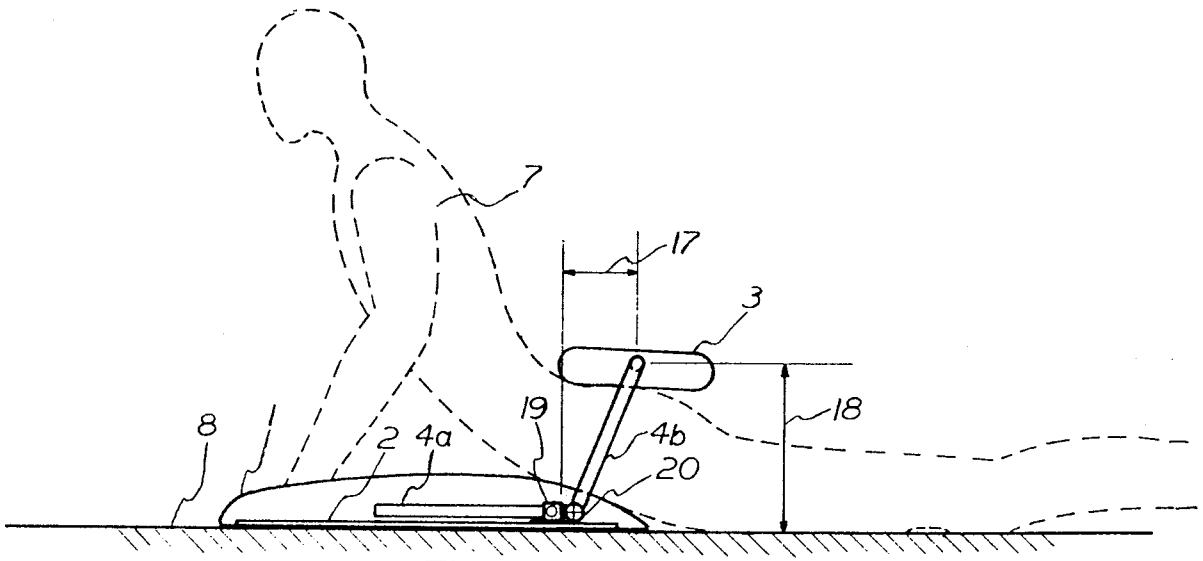
FIG. 6 shows use of the device by one performing dynamic extension exercises.

This second embodiment also allows the next application of the device, which is the facilitation of dynamic extension exercises, as illustrated in FIG. 6. Here, the user begins in the same prone position as that of FIG. 3; however, the downward restraint cushion 3 is repositioned, by adjustment of the dimensions 17 and 18, to contact the user against the area associated with the upper buttocks and lower back so as to exert a downward restraining force upon the same area. The dynamic extension exercise is performed much like a push-up, positioning the hands on the body support cushion 1 and pushing with the arms to raise the upper torso. As the upper torso is raised, the position of the pelvis is held fixed by the downward restraint cushion 3, producing a state of extension in the lumbar spine. The support surface 8 again serves the important function of maintaining the legs in a generally horizontal position.

A third embodiment is illustrated in FIG. 7 and includes all of the features of the first embodiment, with two additional features for use while in the prone position of FIG. 3. What is added is a means for securing the body position relative to the device and a means for manual application of spinal traction to the lumbar spine. A waist strap 14 is fixed around the waist and two retaining straps 15, having front and rear ends, are attached, at their front ends to opposing sides of the waist strap, and at their rear ends to opposing sides of the downward restraint cushion 3. These attachments allow adjustment of the length of the retaining straps 15 and are made using some conventional means, such as VELCRO or buckles. In practice, the retaining strap lengths are adjusted, such that they keep the user from sliding forward on the device, while the pressure of the downward restraint cushion 3 against the lower buttocks keeps the user from sliding to the rear. The waist strap 14 and retaining straps 15 compose the means for securing the body position relative to the device and serve as a component of the means for manually applying spinal traction, which further includes two pulling grips 22 which are located to the front of and on opposing sides of the body support cushion and are rigidly attached to the rigid base member 2. A user properly positioned on the device in a state of flexion, with the waist strap 14 and retaining straps 15 properly secured, as illustrated in FIG. 7, can apply traction by pulling on the pulling grips 22 with the hands, such as to displace the body forward relative to the device. As the body is displaced forward, tension in the retaining straps 15, which pull on the pelvis in the backward direction, will increase to counter the pulling force of the arms. The result is the application of spinal traction to the lumbar spine and lumbosacral joint.

Figure 8:
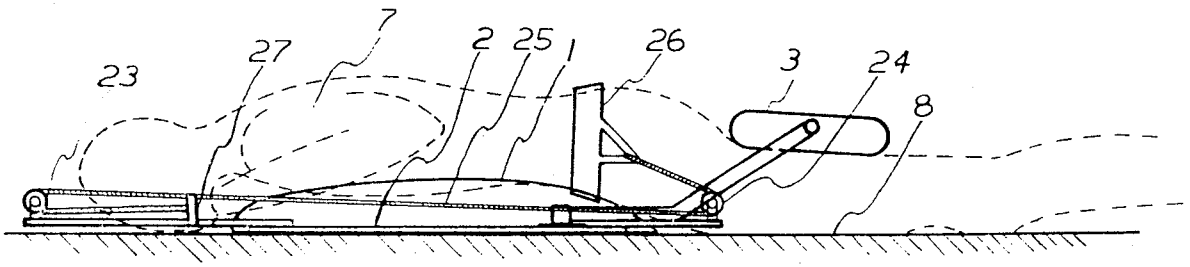
FIG. 8 shows a second means for allowing the user to place the lumbar spine in traction using cables and pulleys.
Figure 9:
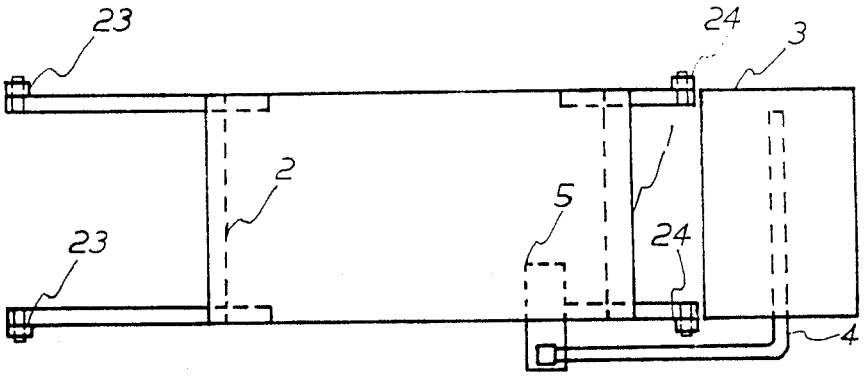
FIG. 9 is a top plan view of the apparatus of FIG. 8, showing the positioning of pulleys.

A fourth embodiment comprises all of the features of the first embodiment, with the addition of alternate means for manual application of spinal traction to the lumbar spine. This embodiment is illustrated in FIGS. 8 and 9. Two front pulley assemblies 23 are located to the front of and on opposing sides of the body support cushion 1 and are rigidly attached to the rigid base member 2. Two rear pulley assemblies 24 are located to the rear of and on opposing sides of the body support cushion 1 and are rigidly attached to the rigid base member 2. Two tension cables 25, having front and rear ends, are located one on each side of the body support cushion 1. The rear ends of the tension cables 25 are attached to opposing sides of a waist harness 26, which is secured around the waist of the user 7, and cable pulling grips 27 are attached to the front ends of the tension cables 25. The tension cables 25 are then threaded through the front and rear pulley assemblies 23 and 24, respectively, in a manner equivalent to that shown in FIG. 8. The user can apply traction by pulling on the cable pulling grips 27. Tension in the tension cables 25 will produce a backward pulling force on the pelvis, via the waist harness 26, which will act to counter the forward pulling force of the arms on the cable pulling grips 27, thus applying traction to the lumbar spine. Note that no displacement of the body relative to the device is necessary to apply traction with this embodiment. Therefore, as in the embodiment of FIG. 7, this embodiment allows the application of traction to the lumbar spine and lumbo-sacral joint while the spine and joint are immobilized in a state of flexion.

Figure 10:
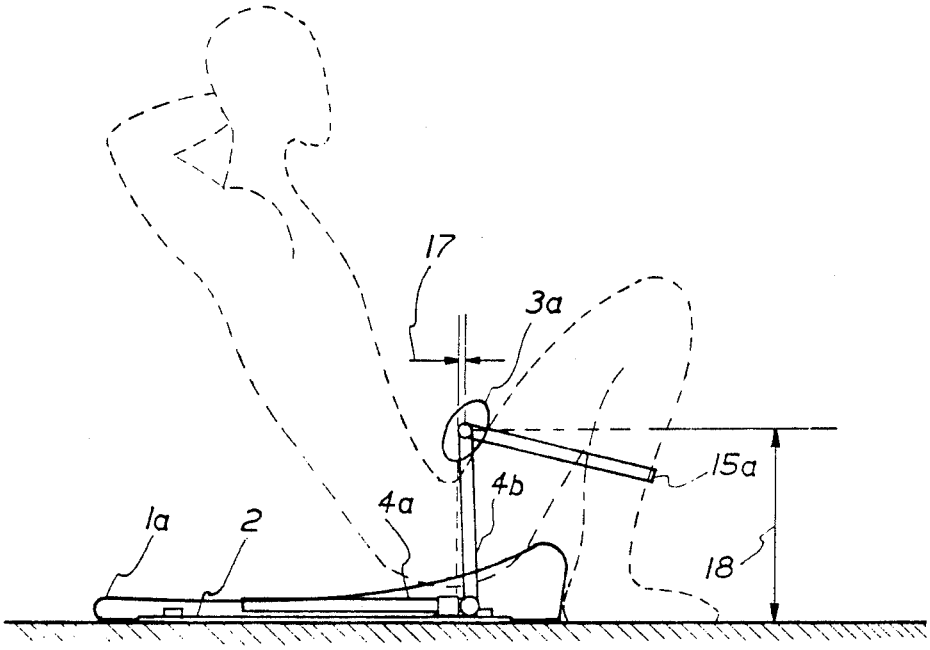
FIG. 10 shows the device having exchanged cushions and which is adjusted for use in performing abdominal exercises.

The fifth embodiment is similar to the second embodiment (adjustability) with changes and is illustrated in FIG. 10. The means for attaching the downward restraint cushion 3 to the rear section of the mechanical connecting member 4*b* allows for the easy removal and replacement of the downward restraint cushion 3 with an alternate downward restraint cushion 3*a* which is smaller in size than downward restraint cushion 3 and has a similar oval profile. The means for attaching the downward restraint cushion 3*a* also allows for the easy removal and replacement of the cushion and may be similar to the attachment means described above. A new body support cushion 1*a*, which replaces the cushion 1 described in the second embodiment, has a generally concave profile along its top surface with an elevation at its rear end being slightly higher than that at its front end.

In this embodiment the device is used to facilitate the performance of abdominal exercises (sit-ups). Strengthening of the abdominal muscles is a commonly prescribed therapy for patients with lower back problems, but the performance of sit-ups, as they are typically executed, can be very stressful to the lumbar spine. Most people find it helpful to have their legs restrained downward when performing sit-ups. When sit-ups are done on a flat support surafce, with the legs extended and downwardly restrained, the lumbar spine is in a state of extension at the start of the sit-up (down) and in a state of flexion at the end of the sit-up (up) (the up position is shown in FIG. 10). As the sit-up is performed there is a considerable compressive stress exerted on the lumbar spine which results from the abdominal muscles pulling to raise the upper torso. Therefore the performance of sit-ups in this way requires the repeated excursion of the lumbar spine from a state of extension to a state of flexion while under comprssive stress and this can be a source of trauma to the lumbar spine. Sit-ups are performed with the device as illustrated in FIG. 10. By adjustment of dimensions 17 and 18 the downward restraint cushion 3*a* is positioned against the upper thigh and acts to restrain the legs downward. A leg retaining strap 15*a* is attached to opposing sides of the downward restraint cushion 3*a*. The strap 15 is positioned around the legs and secured by atatchment means such as VELCRO, and acts to secure the knees in a raised position and to secure correct body position relative to the device. By maintaining the knees in a raised position and correctly positioning the body against the concave contour of the body support cushion 1*a* (as in FIG. 10), the lumbar spine is able to remain in a state of flexion through the entire course of the sit-up, thereby eliminating the spinal excursion from extension to flexion.

Figure 12:
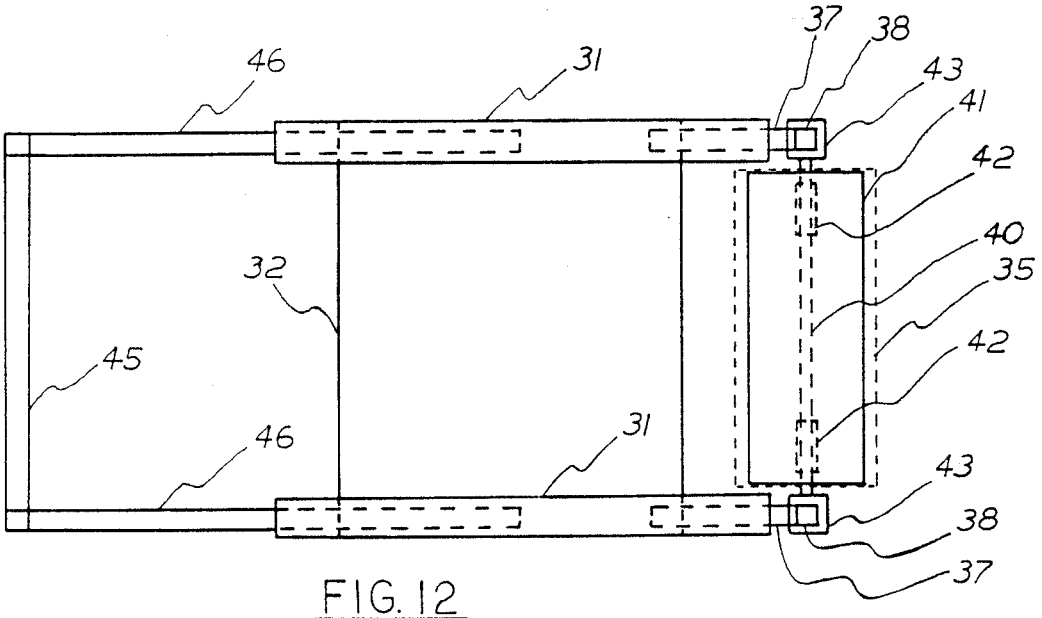
FIG. 12 is a top view of the device of FIG. 11.
Figure 11:
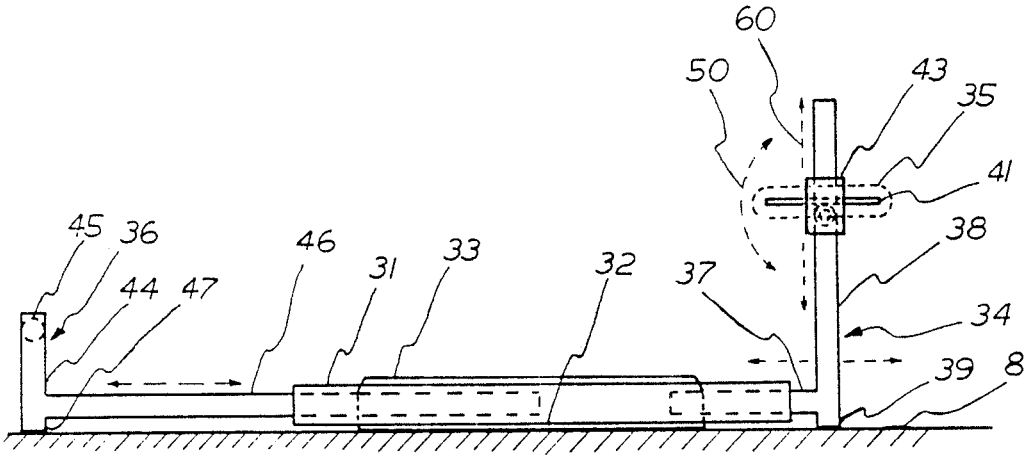
FIG. 11 is a side elevation of another embodiment of the invention.

A final embodiment of the claimed invention is shown in FIGS. 11 and 12.

FIG. 11 shows a side elevation of an exercise therapy device 30. Device 30 includes two elongated frame members 31 and a substantially flat support plate 32 positioned between, and fastened, for example by welding or bolting, to the sides of frame member 31. Frame members 31 may be hollow metal tubular members having a rectangular or circular cross section. Preferably elongated frame members 31 are rectangular and portions thereof have a floor engaging bottom, a flat top and sides the height of which are about 1 inch. Elongated frame members 31 may be constructed of wood and/or plastic.

Flat support plate 32 may be composed of any material. The width of flat support plate 32 is at least wide enough to support the torso of a user of device 30. The height of flat support plate 32 may be equal to the height of elongated frame members 31 and flush therewith. Flat support plate 32 may have a cushion 33 shown in the broken lines of FIG. 11 fastened to the top thereof and flat support plate 32 and cushion 33 may combine to create a surface which is flush with the height of elongated frame members 31. Preferably, flat support plate 32 is relatively thin and attached to the bottom of the elongated frame members 31 and engages the floor as shown in FIG. 11.

Device 30 also includes at least one mechanical connecting member 34 attached to the rear end of an elongated frame member 31; a downward restraint cushion 35 is attached to mechanical connecting member 34, and grips 36 are attached to the front end of elongated frame members 31.

Mechanical connecting member 34 may be composed of a single tubular member fastened to the top of the rear portion or end of a single elongated frame member 31. Mechanical connecting member 34 projects upwardly away from the floor, being perpendicular to the elongated frame member that it is attached to. Device 30 may have two similar mechanical connecting members 34. If two mechanical connecting members 34 are used, a first is connected to the top of the rear portion or end of a first elongated frame member 31 and a second mechanical connecting member 34 is connected to the top of the rear portion or end of a second elongated frame member 31 so that each mechanical connecting member 34 is parallel to each other and perpendicular to an associated elongated frame member 31.

Mechanical connecting members 34, as shown in FIG. 11, may alternatively be composed of an L-shaped device wherein a foot 37 of the L is telescopically received in the hollow end of an elongated frame member 31 and a leg 38 of the L is perpendicular to the elongated frame member 31 and projects upwardly away from the floor. The L-shaped device may also have a heel 39 or a floor engaging portion for stabilizing the device 30. Device 30 may be composed, as described above, of two mechanical connecting members both having the L-shaped sections. Each member has a foot telescopically received in an associated elongated frame member 31 so that legs 38 of L-shaped mechanical connecting members 34 are parallel to one another being separated by the width of flat support plate 32.

Downward restraint cushion 35 is composed of a rigid bar 40 shown in broken lines of FIG. 12 and a cushion 41, fastened thereto by fastening members 42. Fastening members 42 also shown in broken lines of FIG. 12 may be constructed so that rotation of cushion 41 about bar 40 is possible (see the arrow 50 of FIG. 11). Downward restraint cushion 35 has a length substantially equal to the width of the flat support plate 32. Bar 40 of downward restraint cushion 35 may be fastened at its ends, for example by welding, to tubular side sections 43. Tubular side sections 43 have an internal perimeter slightly larger than the outer perimeter of legs 38 of mechanical connecting member 34. Side sections 43 slip over the outer periimeter of legs 38 providing vertical sliding adjustment for downward restraint cushion 35 as shown by arrow 60 of FIG. 11. Each of these tubular side sections has a single hole, and legs 38 of mechanical connecting members 34 have equally spaced, vertically aligned holes. The single holes 34 of tubular side sections 43 are capable of overlapping alignment with the holes of legs 38. Pins are inserted into the overlapping holes of the side sections and legs 38 to arrest the vertical sliding adjustment of downward restraint cushion 35. As seen from the drawings the downward restraint cushion is elevated above and located behind the rear end of the flat support plate.

Grip 36 is secured to the front end of device 30. Grip 36 may comprise two relatively short members 44 welded to the top of the front portion or end of each elongated frame member 31 so that the short members project upwardly away from floor 8 perpendicular to the elongated frame members 31. Grip 36 may also comprise a circular bar 45 having a length substantially equal to width of flat support plate 32 and the length of the downward restraint cushion 35. The bar is fastened, for example by welding it to the tops of short members 44 so that bar 45 is suspended above the floor between short members 44. As seen in FIG. 11 circular holes may be drilled through to the top of short members 44 and circular bar 45 can be suspended above floor 8 by placing the ends of the bar in the drilled holes. Bar 45 is elevated relative to elongated frame members 31 but position below downward restraint cushion 35.

Device 30 may be used by all. Device 30 can be made adjustable in its length at its rear end by sliding foot members away from elongated frame members 31. The sides of the rear ends of elongated frame members 31 may be provided with horizontally aligned equally spaced holes drilled therethrough. A single hole, capable of overlapping alignment with any of the horizontally aligned holes on the elongated frame members 31 is positioned through the sides of foot members 37. A pin can be inserted in the overlapping holes to arrest the sliding motion of the foot members.

The front end of device 30 may also be constructed so that grip 36 can be slidably extended away from flat support plate 32. As seen in FIGS. 11 and 12 horizontal extension members 46, which are extensions of elongated frame members 31, have an outer perimeter slightly smaller than the inner perimeter of elongated frame member 31 and the horizontal extension members 46 are slidably received in the front hollow end of elongated frame members 31. The sides of horizontal extension members 46 have horizontally aligned, equally spaced holes. A hole is drilled through each of the sides of a front portion of elongated frame members 31. The holes of the sides of elongated frame members 31 are capable of overlapping alignment with one of the equally spaced holes on the horizontal extension members 46. A pin can be inserted through the overlapping holes to arrest the sliding motion of the horizontal extension members and elongated frame member 31.

At the front end of horizontal extension members 46, grip 36 may be secured to each of the horizontal extension members. As described above, and as seen in FIG. 11 grip 36 can be two short members 44 welded to the top of each horizontal extension members 46 so that short members 44 project away from the floor and are perpendicular to horizontal extension members 46. A bar 45 substantially as described above, can be positioned on the top of perpendicular members 44 which also may facilitate the gripping capacity of device 30. A chin 47 is provided at the bottom of the short perpendicular members for further supporting and aiding the stability of the device.

A user of device 30, as described in this embodiment, can conduct flexion and extension exercises of the lumbar spine and other stretching exercises.

For instance, laying in a prone position with the downward restraint cushion located on the lumbar sacral joint, the user positions his hands below his shoulders and slowly raises his upper torso, with his arms, until his elbows are locked (similar to the positions shown in FIG. 6), This position is an extension exercise.

The user could also face the ceiling in a room, and position his lumbar sacral joint on the downward restraint cushion (which has now been rotated so that the cushion faces the ceiling). The user would place the scapulae of his shoulders on the flat support plate, and reach back with his hands and grip the gripping bar or the short perpendicular gripping members while letting his legs extend beyond the rear of the device. In this manner immobilization in extension of the lumbar spine and lumbar sacral joint can be conducted.

Similarly, the user could position his feet on or below the gripping bar, his buttocks on the flat support plate and lean back on the downward restraint cushion with his arms stretched in the direction of the rear of the device. In this position the device aids in the extension of the cervical and upper thoracic (dorsal) spine.

Other stretching exercises using the device of the invention are also possible.

While specific embodiments of the apparatus and method of using the apparatus have been shown and described, it should be apparent that many modifications can be made thereto without departing from the spirit and scope of the invention. For instance where a user of the device for some reason finds a body support cushion having a flat, convex or concave top profile more comfortable than the specific cushion set forth in individual embodiments above then such a modification is within the spirit and scope of the invention. Accordingly, the invention is not limited by the foregoing description, but is only limited by the scope of the claims appended hereto.

I claim:

1. An exercise therapy device for the back, comprising:

a rigid base member being thin and flat having a floor-engaging bottom, a top face, a front and a rear end;

a body support cushion fastened to the top face of said rigid base member, and a downward restraint cushion having a length substantially equal to the width of the body support cushion;

a mechanical connecting member having a front and a rear end;

means for attaching said downward restraint cushion to said rear end of said mechanical connector member and means for attaching said front end of said mechanical connecting member to said rigid base member so that said downward restraint cushion is elevated above and located directly behind the rear of said body support cushion; and means for gripping attached to the front end of said rigid base member wherein at least a first portion of said gripping means is generally perpendicular to the rigid base member.

2. The device as recited in claim 1, further comprising an air bladder located at the base of and toward the rear of said body support cushion, said air bladder includes means for inflating and deflating said air bladder.

3. The device as recited in claim 1, wherein means for attaching said downward restraint cushion to said rear end of said mechanical connecting member includes means for easily removing and replacing said downward restraint cushion.

4. The device as recited in claim 1, wherein said body support cushion is rectangular in shape, of a generally convex profile along its top surface and has a generally flat profile along its bottom surface.

5. The device as recited in claim 1, wherein said body support cushion is rectangular in shape, of a generally concave profile along its top surface, and has a generally flat profile along its bottom surface.

6. The device as recited in claim 1, wherein said body support cushion is rectangular in shape and has a generally flat profile along its top and bottom surface.

7. A lower back therapy device which comprises:

a body support cushion having a generally flat profile along its bottom surface, and constructed primarily of resilient material;

a rigid base member upon which the body support cushion is mounted, said rigid base member having a floor engaging bottom;

means for attaching and removing and replacing said concave body support cushion to said rigid base member;

a downward restraint cushion rectangular in shape, having an oval profile, constructed primarily of resilient cushioning material and having a length substantially equal to the width of said body support cushion;

a mechanical connecting member having a front and rear end;

means for easily attaching and removing and replacing said downward restraint cushion to said rear end of said mechanical connecting member;

means for rigidly attaching said front end of said mechanical connecting member to said rigid base member;

means for adjusting the horizontal distance between said body support cushion and said downward restraint cushion;

means for adjusting the vertical distance between said downward restraint cushion and said rigid base member; and means for gripping located to the front of said body support cushion being rigidly attached to said rigid base member, wherein said gripping means comprises a raised horizontal bar located above said rigid base but below said downward restraint cushion and being substantially equal in width to the width of the downward restraint cushion.

8. The device as recited in claim 7, wherein said body support cushion has a generally convex profile along its top surface and said downward restraint cushion may be utilized to exert a downward restraining force on selected areas of the body.

9. The device as recited in claim 8, wherein said body support cushion further comprises an air bladder which is located at the base of, and toward the rear of, said body support cushion, a means for inflating and deflatilng said air bladder and said means for attaching said body support cushion to said rigid base member comprises means for easily removing and replacing said body support cushion relative to said rigid base member.

10. The device as recited in claim 7, wherein said body support cushion has a generally concave profile along its top surface and said downward restraint cushion may be utilized to exert a downward restraining force on selected areas of the body.

11. The device as recited in claim 7, wherein said body support cushion has a generally concave profile along its top surface and the elevation of the rear end of said body support cushion is slightly higher than its front end, whereby said lower back therapy device facilitates the performance of abdominal exercises.

12. An exercise therapy device for the back, comprising:

first and second parallel elongated frame members being separated by the width of a substantially flat support plate, said flat support plate being fastened to said frame members, the width of said flat support plate being at least wide enough to support the torso of a user of the device;

a downward restraint cushion having a length substantially equal to the width of said flat support plate;

at least one mechanical connecting member fastened to a rear portion of a first elongated frame member and being substantially perpendicular to said frame member and extending upwardly from the floor;

means for attaching said downward restraint cushion to said mechanical connecting member so that said downward restraint cushion is elevated above the rear portion of said flat support plate; and means for gripping fastened to a front portion of each elongated frame member, said means including two relatively short members of said elongated frame members so that said members extend upwardly and perpendicular relative to said elongated frame members.

13. The device as recited in claim 12, further comprising a body support pad mounted on said flat support plate.

14. The device as recited in claim 12, wherein said elongated frame members comprise at least two telescoping sections for adjusting the length of the frame members.

15. The device as recited in claim 12, further comprising a second mechanical connecting member fastened to the rear portion of said second frame member being parallel to said first mechanical connecting member, and said downward restraint cushion is slidingly attached, for adjusting its vertical height, to said mechanical connecting members.

16. The device as recited in claim 12, further comprising, a horizontal bar, substantially equal in length to the length of the downward restraint cushion and being fastened to a top portion of each of said relatively short members, whereby the horizontal bar is elevated relative to the frame member but positioned below the downward restraint cushion.

17. A lower back therapy device, which comprises:

a body support cushion having a generally convex profile along its top surface and a generally flat profile along its bottom surface constructed primarily of resilient material;

a rigid base member upon which the body support cushion is mounted;

a downward restraint cushion rectangular in shape, having an elongated flattened oval profile constructed primarily of resilient cushioning material;

a mechanical connecting member having a front and a rear end;

means for attaching said downward restraint cushion to said rear end of said mechanical connecting member;

means for securing a desired body position comprising a waist strap for securing the waist of a user and two retaining straps having front and rear ends wherein said front ends of said retaining straps are attached to opposing sides of said waist strap and said rear ends of said retaining straps are attached to opposing sides of said downward restraint cushion; and means for gripping located to the front of said body support cushion, and being rigidly attached to said rigid base member.

18. The device as recited in claim 17, wherein said means for gripping includes two pulling grips located to the front of and on opposing sides of said body support cushion.

19. A lower back therapy device, which comprises:

a body support cushion having a generally convex profile along its top surface and a generally flat profile along its bottom surface constructed primarily of resilient material;

a rigid base member;

means for attaching said body support cushion to said rigid base member;

a downward restraint cushion rectangular in shape, having an elongated flattened oval profile constructed primarily of resilient cushioning material;

a mechanical connecting member having a front and a rear end;

means for attaching said downward restraint cushion to said rear end of said mechanical connecting member;

means for rigidly attaching said front end of said mechanical connecting member to said rigid base member; and means for securing a desired body position comprising a waist strap for securing the waist of a user and two retaining straps having front and rear ends wherein said front ends of said retaining straps are attached to opposing sides of said waist strap and said rear ends of said retaining straps are attached to opposing sides of said downward restraint cushion.

20. A lower back therapy device, which comprises:

a body support cushion having a generally convex profile along its top surface and a generally flat profile along its bottom surface constructed primarily of resilient material;

a rigid base member;

means for attaching said body support cushion to said rigid base member;

a downward restraint cushion rectangular in shape, having an elongated flattened oval profile constructed primarily of resilient cushioning material;

a mechanical connecting member having a front and a rear end;

means for attaching said downward restraint cushion to said rear end of said mechanical connecting member;

means for rigidly attaching said front end of said mechanical connecting member to said rigid base member;

two tension cables having front and rear ends;

a waist harness;

two front pulley assemblies; and two rear pulley assemblies, said rear ends of said tension cables are attached to opposing sides of said waist harness, said front pulley assemblies are located to the front of and on opposing sides of said body support cushion and rigidly attached to said rigid base member, said rear pulley assemblies located to the rear of, and on opposing sides of, said body support cushion and rigidly attached to said rigid base member, said tension cables routed from said waist harness through said rear pulley assemblies, then through said front pulley assemblies, and said front ends of said tension labels each comprises a cable pulling grip.

21. An exercise therapy device for the back comprising:

first and second parallel elongated frame members, being adjustable in length at a front portion thereof, or a rear portion thereof or both, said elongated frame members being separated by the width of a substantially flat support plate, said flat support plate being fastened to the sides of said frame members, the width of said flat support plate being at least wide enough to support the torso of a user of the device;

a downward restraint cushion having a length substantially equal to the width of said flat support plate;

at least one mechanical connecting member fastened to the rear portion of a first elongated frame member and being substantially perpendicular to said frame member and extending upwardly from the floor;

means for attaching said downward restraint cushion to said mechanical connecting member so that said downward restraint cushion is vertically adjustable and elevated above and located directly behind the rear portion of said flat support plate; and means for gripping fastened to the front portion of each elongated frame member, said means including two relatively short members fastened to said front portion of said elongated frame members so that said members extend upwardly and perpendicular relative to said elongated frame member.

* * * * *